US007228628B2

(12) United States Patent
Wolfel et al.

(10) Patent No.: US 7,228,628 B2
(45) Date of Patent: Jun. 12, 2007

(54) ELECTRICAL CONNECTOR AND METHOD OF MAKING THE SAME

(75) Inventors: Lee A. Wolfel, Goshen, CT (US); Robert Larsen, Oakville, CT (US); Robert D. Godburn, Jr., Waterbury, CT (US)

(73) Assignee: Winchester Electronics Corporation, Wallingford, CT (US)

( * ) Notice: Subject to any disclaimer, the term of this patent is extended or adjusted under 35 U.S.C. 154(b) by 134 days.

(21) Appl. No.: 11/091,490

(22) Filed: Mar. 29, 2005

(65) Prior Publication Data

US 2005/0221688 A1 Oct. 6, 2005

Related U.S. Application Data

(60) Provisional application No. 60/558,547, filed on Apr. 2, 2004.

(51) Int. Cl.
*H01R 43/04* (2006.01)

(52) U.S. Cl. ..... 29/882; 29/874; 29/884

(58) Field of Classification Search ..... 29/862, 29/863, 864, 882, 852, 874, 884
See application file for complete search history.

(56) References Cited

U.S. PATENT DOCUMENTS 1,147,450 A * 7/1915 Shaw ..... 439/877
2,068,639 A * 1/1937 Alsaker et al. ..... 238/14.12
2,247,041 A * 6/1941 Bergan ..... 439/877
2,957,226 A * 10/1960 Dibner ..... 29/874
2,997,411 A * 8/1961 Woolley ..... 156/221
RE25,847 E * 8/1965 Forney, Jr. ..... 29/862
3,956,823 A * 5/1976 Kuo ..... 29/863
4,621,421 A * 11/1986 O'Loughlin ..... 29/874
4,775,337 A * 10/1988 Van Wagener et al. ..... 439/883
4,877,176 A 10/1989 Kubis
4,923,414 A 5/1990 Sitzler
4,953,289 A * 9/1990 Schreck et al. ..... 29/863
5,915,999 A 6/1999 Takenaka et al.
5,960,540 A * 10/1999 Pentz ..... 29/861
6,352,450 B1 * 3/2002 Bronk et al. ..... 439/660

FOREIGN PATENT DOCUMENTS

GB 1 149 332 4/1969
GB 2 081 140 A 2/1982

* cited by examiner

*Primary Examiner*—Carl J. Arbes
(74) *Attorney, Agent, or Firm*—Rothwell, Figg, Ernst & Manbeck

(57) ABSTRACT

In one aspect, the invention provides a method for making an electrical connector. The method may include: obtaining a part having a first end portion, a second end portion, and an interim 1 portion between the first and second end portions; flattening the second end portion; trimming the flattened second end portion; and forming a hole in the flattened second end portion.

18 Claims, 4 Drawing Sheets

ELECTRICAL CONNECTOR AND METHOD OF MAKING THE SAME

This application claims the benefit of U.S. Provisional Patent Application No. 60/558,547, filed on Apr. 2, 2004, the disclosure of which is incorporated herein by reference in its entirety.

BACKGROUND OF THE INVENTION

1. Field of the Invention

The present invention relates to electrical connectors and a method for making the same. In one aspect, the invention relates to pin shaped connectors.

2. Discussion of the Background

There is a need for a method of producing an electrical connector in a cost competitive manner.

SUMMARY OF THE INVENTION

The present invention provides an electrical connector and a method for making the same.

In one embodiment, a method for making an electrical connector includes: obtaining a part having a first end portion, a second end portion, and an interim portion between the first and second end portions; flattening the second end portion, wherein the second end portion has a first face and a second face; trimming the flattened second end portion; and forming a hole in the flattened second end portion, the hole extending from the first face to the second face. Advantageously, the part may be selectively plated.

The above and other features and advantages of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, help illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENT

Figure 1:
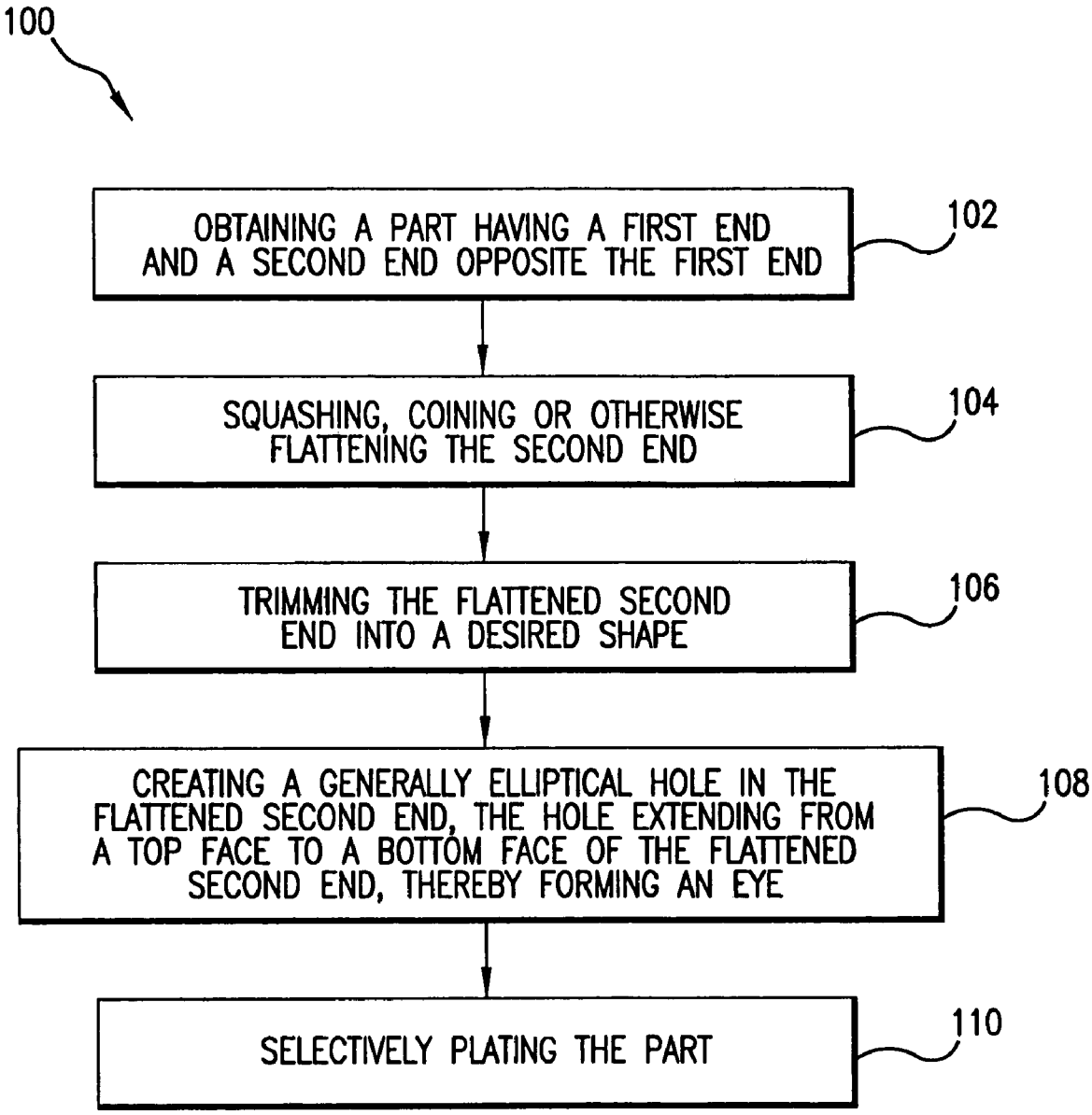
FIG. 1 is a flow chart illustrating a process for making an electrical connector according to an embodiment.
Figure 2A:
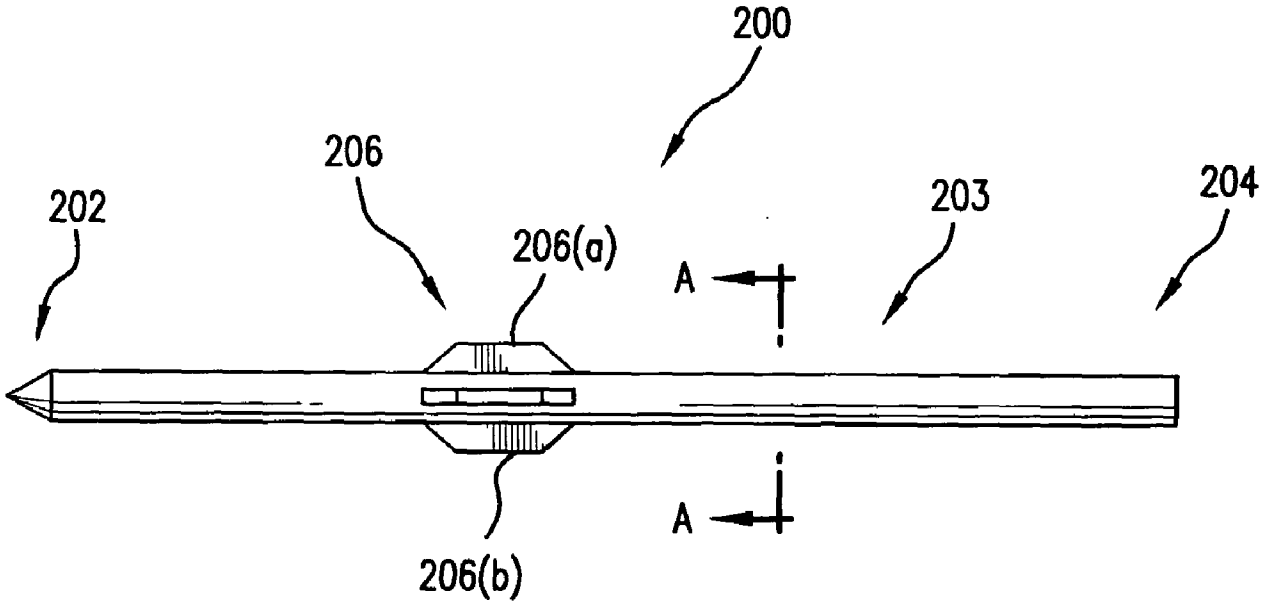
FIGS. 2A and 2B illustrate a pin shaped part having a chamfered mating end and a second end opposite the chamfered mating end.
Figure 2B:
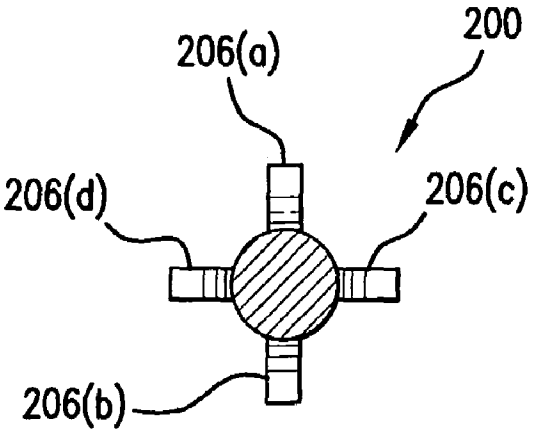

FIG. 1 is a flow chart illustrating a process 100, according to an embodiment of the invention, for making an electrical connector. Process 100 may being in step 102, where a part 200 is obtained (see FIG. 2A). In some embodiments, part 200 is a wire formed pin and includes a chamfered mating end 202, a second end 204 opposite the chamfered mating 202 end, and an interim portion 203 between ends 202 and 204. Part 200 may also have a retention star 206 formed thereon. In some embodiments, part 200 is generally elongate, cylindrical in shape and rigid. Thus, in some embodiments, part 200 has a generally circular cross section as shown in FIG. 2B. In embodiments where part 200 has a generally circular cross section, the diameter of the part, in some embodiments, may be generally between 0.12 to 0.03 inches. In one embodiment, the diameter is about 0.06 inches. Members 206(*a*)–(*d*), which extend radially from the outer surface of part 200 and which make up star 206, are also illustrated in FIG. 2B.

Figure 3:
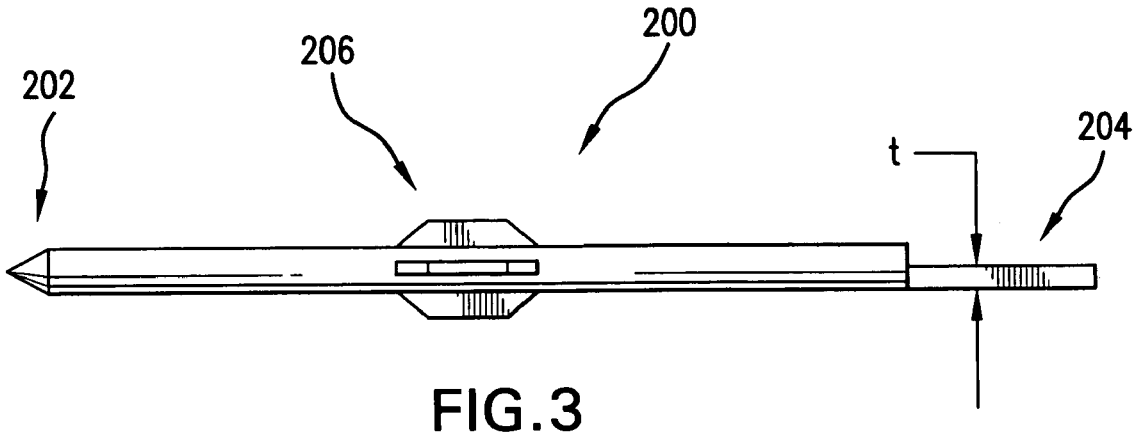
FIG. 3 is an illustration of the part shown in FIG. 2, wherein the end opposite the chamfered mating end is flattened.

In step 104, the second end 204 is squashed, coined or otherwise flattened (see FIG. 3, which shows a side view of part 200). After step 104, second end 204 may have a generally rectangular cross section. In some embodiments, the thickness (t) of the flattened end is between about 0.01 to 0.06 inches. In some embodiments, the preferred thickness (t) is about 0.03 inches.

Figure 4:
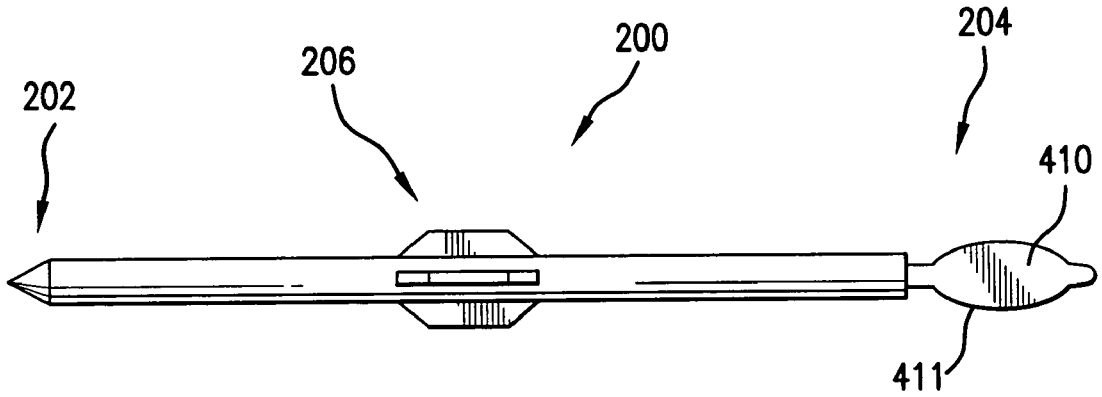
FIG. 4 is an illustration of the part after the flattened end has been trimmed into a desired shape.
Figure 5:
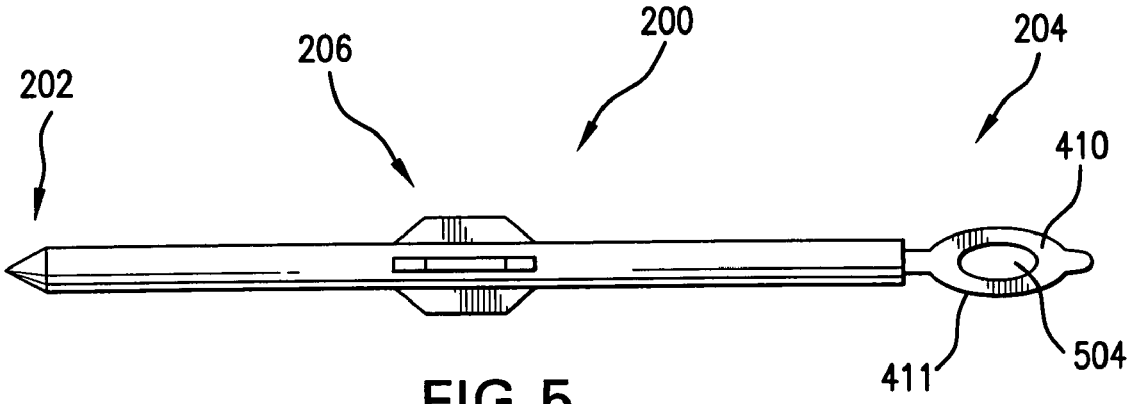
FIG. 5 is an illustration of an electrical connector according to an embodiment.
Figure 6A:
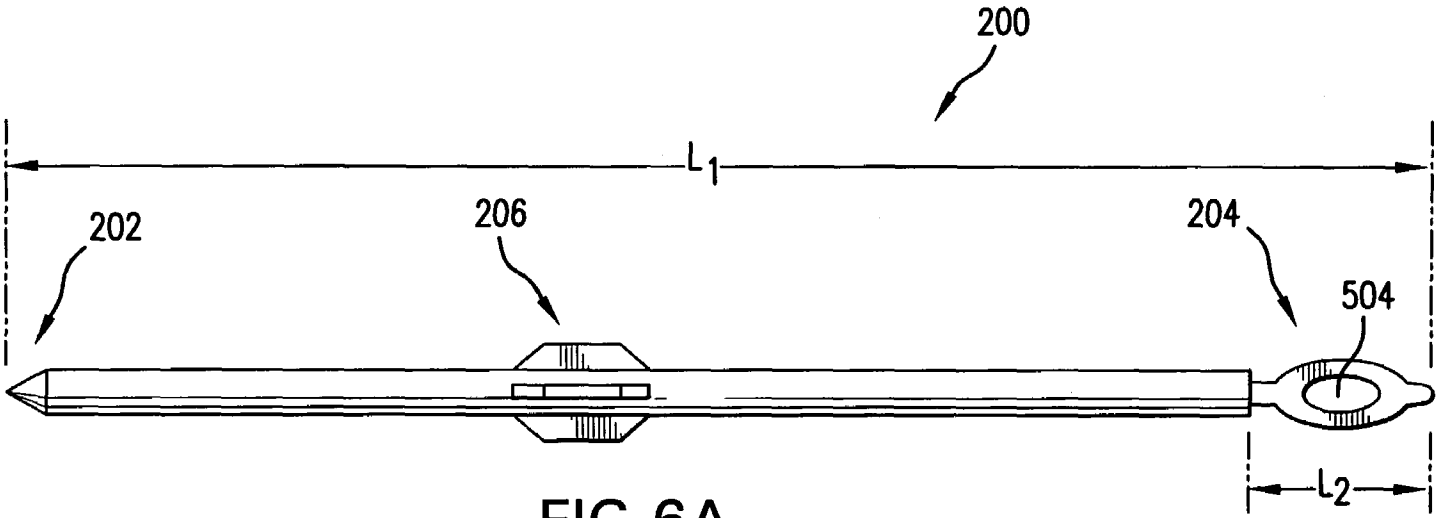
FIG. 6A shows an embodiment of an electrical connector according to the present invention.
Figure 6B:
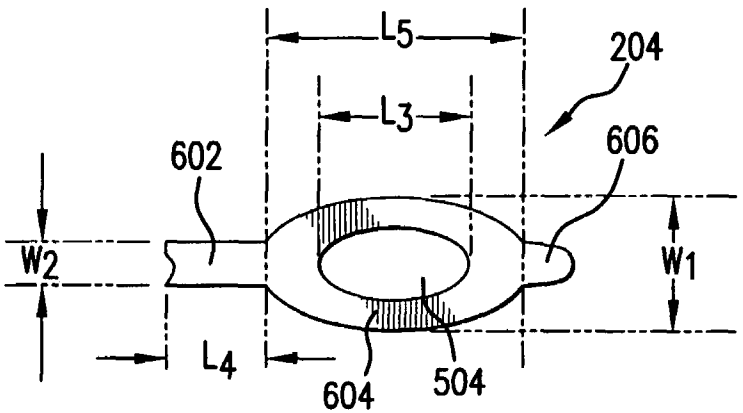
FIG. 6B illustrates a flattened end portion according to an embodiment.

In step 106, the flattened second end 204 is processed into a desired shape (see FIG. 4, which shows a top view of part 200 and FIG. 6B). For example, the flattened second end may be trimmed. In step 108, a hole 504 is created in the flattened second end 204, wherein the hole extends from a top face 410 to a bottom face 411 of the flattened second 204, thereby forming an eye (see FIG. 5, which is also a top view of part 200). In some embodiments, hole 504 is generally elliptical in shape. In step 110, part 200 is selectively plated. That is, one or more selected portions of part 200 are plated.

Referring now to FIG. 6A, FIG. 6A illustrates part 200 according to some embodiments. In some embodiments, the length (L1) of part 200 may generally range between about 1 and 4 inches and the length (L2) of end portion 204 may generally range between about 0.1 and 0.5 inches. In some embodiments, L1 is preferably about 2 inches and L2 is about 0.2 inches.

Referring now to FIG. 6B, FIG. 6B illustrates flattened end portion 204 according to some embodiments. In some embodiments, flattened end portion 204 includes a first end section 602, a second end section 606 and an interim section 604 disposed between end sections 602 and 606. The length (L4) of first end section 602, in some embodiments, may generally range between 0.1 and 0.02 inches. In one embodiment, L4 is about 0.045 inches. The width (W2) of first end section 602, in some embodiments, may generally range between 0.08 and 0.02 inches. In one embodiment, W2 is about 0.04 inches. As shown in FIG. 6B, in some embodiments, the width of section 602 is generally uniform along the entire length of section 602.

The length (L5) of the interim section 604, in some embodiments, may generally range between 0.3 and 0.05 inches. In one embodiment, L5 is about 0.15 inches. The width (W1) of interim section 604, in some embodiments, may generally range between 0.15 and 0.03 inches. In one embodiment, W1 is about 0.07 inches. As shown in FIG. 6B, in some embodiments, the width of section 604 is generally non-uniform along the length of section 604. The width may be widest across the middle of section 604 as shown in the figure. The length (L3) of hole 504, in some embodiments, may generally range between 0.2 and 0.05 inches. In one embodiment, L3 is about 0.1 inches.

Although the above described process is illustrated as a sequence of steps, it should be understood by one skilled in the art that at least some of the steps need not be performed in the order shown, and, furthermore, some steps may be omitted and additional steps added without departing from the scope of the invention.

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method for making an electrical connector, comprising:

obtaining a part having a first end portion, a second end portion, and an interim portion between the first and second end portions;

flattening the second end portion, wherein the flattened second end portion has a first face and a second face;

trimming the flattened second end portion; and forming a hole in the flattened second end portion, the hole extending from the first face to the second face, wherein the step of trimming the flattened second end portion comprises removing portions of the flattened second end portion, thereby forming the flattened end portion into a desired shape, and after the trimming step is performed, the flattened second end portion has a first end section, a second end section and an interim section between the first and second end sections, wherein the first end section is between the interim portion of the part and the interim section of the flattened second end section, and wherein the first end section of the flattened second end portion has a generally uniform width and a width of the interim section of the flattened second end portion is greater than the width of the first end section.

2. The method of claim 1, wherein the first end portion of the part has been chamfered.

3. The method of claim 1, wherein the first end portion of the part comprises a pointy end section.

4. The method of claim 1, wherein the part has a retention star formed thereon.

5. The method of claim 1, wherein the part comprises a plurality of members, each member extending radially from an outer surface of the interim portion of the part.

6. The method of claim 1, wherein the part is a wire formed pin having a chamfered mating end.

7. The method of claim 1, wherein the thickness of the flattened second end portion is between about 0.01 to 0.06 inches.

8. The method of claim 7, wherein the thickness of the flattened second end portion is about 0.030 inches.

9. The method of claim 7, wherein the length of the second end portion is between about 0.45 to 0.1 inches.

10. The method of claim 9, wherein the length of the second end portion is about 0.2 inches.

11. The method of claim 9, wherein the length of the part is between about 1 and 4 inches.

12. The method of claim 11, wherein the length of the part is about 2 inches.

13. The method of claim 1, wherein the interim section of the flattened second end portion has a non-uniform width, which width is greatest across the middle of the interim section.

14. The method of claim 1, wherein the second end section has a generally pointed end.

15. The method of claim 1, wherein the hole is generally elliptical in shape.

16. The method of claim 1, further comprising selectively plating the part.

17. The method of claim 1, wherein the part is generally elongate, cylindrical, rigid.

18. The method of claim 1, wherein the length of the hole is substantially ⅔ the length of the interim section of the flattened second end portion.

* * * * *